US007798459B2

(12) United States Patent
Dickson

(10) Patent No.: US 7,798,459 B2
(45) Date of Patent: Sep. 21, 2010

(54) LASER BEAM GUARD CLAMPS

(75) Inventor: Richard K. Dickson, Stockton, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 624 days.

(21) Appl. No.: 11/809,704

(22) Filed: May 31, 2007

(65) Prior Publication Data

US 2008/0296822 A1 Dec. 4, 2008

(51) Int. Cl.
*A47G 1/10* (2006.01)

(52) U.S. Cl. ..... 248/316.3; 269/43; 269/136; 269/282

(58) Field of Classification Search ..... 248/316.1, 248/316.4, 316.8, 316.3; 269/254, 254 CS, 269/256, 269, 43, 136, 282; D3/262; 24/339
See application file for complete search history.

(56) References Cited

U.S. PATENT DOCUMENTS 279,481 A * 6/1883 Eyster ..... 248/113
2,703,594 A * 3/1955 Slinkard ..... 269/154
4,323,226 A * 4/1982 Close ..... 269/208
4,915,273 A * 4/1990 Allen ..... 224/462
5,168,766 A 12/1992 Stoffel
5,562,381 A 10/1996 Cucchi
5,636,856 A 6/1997 Luitz et al.
6,145,851 A 11/2000 Heber
6,601,254 B1 8/2003 Walz
6,604,744 B2 8/2003 Monge
2003/0029684 A1 2/2003 Forster

* cited by examiner

*Primary Examiner*—Gwendolyn Baxter
(74) *Attorney, Agent, or Firm*—James S. Tak

(57) ABSTRACT

A quick insert and release laser beam guard panel clamping apparatus having a base plate mountable on an optical table, a first jaw affixed to the base plate, and a spring-loaded second jaw slidably carried by the base plate to exert a clamping force. The first and second jaws each having a face acutely angled relative to the other face to form a V-shaped, open channel mouth, which enables wedge-action jaw separation by and subsequent clamping of a laser beam guard panel inserted through the open channel mouth. Preferably, the clamping apparatus also includes a support structure having an open slot aperture which is positioned over and parallel with the open channel mouth.

5 Claims, 4 Drawing Sheets

LASER BEAM GUARD CLAMPS

I. FEDERALLY SPONSORED RESEARCH OR DEVELOPMENT

The United States Government has rights in this invention pursuant to Contract No. W-7405-ENG-48 between the United States Department of Energy and the University of California for the operation of Lawrence Livermore National Laboratory.

II. BACKGROUND OF THE INVENTION

A. Technical Field

The present invention relates to spring-loaded clamps, and more particularly to a quick insert and release spring-loaded laser beam guard clamp for use on optical tables for laser experiments and applications.

B. Description of the Related Art

Optical tables and breadboards are used to conduct laser experiments and applications. The setup of such laser experiments and applications often include the use of sheet metal panels as laser beam guards to provide protection against potential laser beam eye and burn injuries. Such sheet metal guards are typically bolted directly to the optical tables/breadboards which can make installation and removal laborious and difficult. Moreover, access to the laser setup and equipment when making adjustment is also impeded.

What is necessary, therefore, is a method and apparatus by which laser beam guard panels may be quickly positioned and removed to facilitate adjustments to laser experiments and applications.

III. SUMMARY OF THE INVENTION

One aspect of the present invention includes a clamping device comprising: a base plate; first and second jaws mounted on the base plate with at least one of said jaws being slidably displaceable relative to the other; and means for resiliently biasing the slidably displaceable jaw(s) towards the other jaw for exerting a clamping force therebetween, said first and second jaws each having a face acutely angled relative to the other face to form a V-shaped, open channel mouth for enabling wedge-action jaw separation by and subsequent clamping of a panel inserted through the open channel mouth.

Another aspect of the present invention includes a quick insert and release laser beam guard panel clamping apparatus comprising: a base plate having means for mounting to an optical table; a first jaw fixedly mounted on the base plate; and a spring-loaded second jaw slidably carried by the base plate and resiliently biased towards the first jaw for exerting a clamping force therebetween, said first and second jaws each having a face acutely angled relative to the other face to form a V-shaped, open channel mouth for enabling wedge-action jaw separation by and subsequent clamping of a laser beam guard panel inserted through the open channel mouth.

Another aspect of the present invention includes a quick insert and release laser beam guard panel clamping apparatus comprising: a base plate having means for mounting to an optical table; a first jaw fixedly mounted on the base plate; a spring-loaded second jaw slidably carried by the base plate and resiliently biased towards the first jaw for exerting a clamping force therebetween; said first and second jaws each having a face acutely angled relative to the other face to form a V-shaped, open channel mouth for enabling wedge-action jaw separation by and subsequent clamping of a laser beam guard panel inserted through the open channel mouth; and means mounted on the base plate for providing an open slot aperture over and parallel with the open channel mouth.

IV. BRIEF DESCRIPTION OF THE DRAWINGS

The accompanying drawings, which are incorporated into and form a part of the disclosure, are as follows.

V. DETAILED DESCRIPTION

Generally, the present invention is a quick insert and release clamping device/apparatus which is particularly useful for positioning laser beam guard panels on an optical table and breadboard, such as for example optical tables and breadboards commercially available from Newport Corporation of Irvine, Calif.

The main components of the clamping device include a base plate, first and second jaws mounted on the base plate with at least one of the jaws being slidably displaceable relative to the other, and means for resiliently biasing the slidably displaceable jaw(s) towards the other jaw for exerting a clamping force therebetween. The first and second jaws each have a face acutely angled relative to the other face to form a V-shaped, open channel mouth for receiving a guard panel, and enabling wedge-action jaw separation by and subsequent clamping of the guard panel inserted through the open channel mouth. The base plate is the platform upon which all other components are mounted and carried, and preferably includes means for mounting to a work surface, such as an optical table. Preferably, the first jaw is affixed to the base plate, and the second jaw is spring-loaded and slidably carried by the base plate to exert a clamping force. Furthermore, the clamping apparatus also preferably includes a support structure having an open slot aperture which is positioned over and parallel with the open channel mouth.

Figure 1:
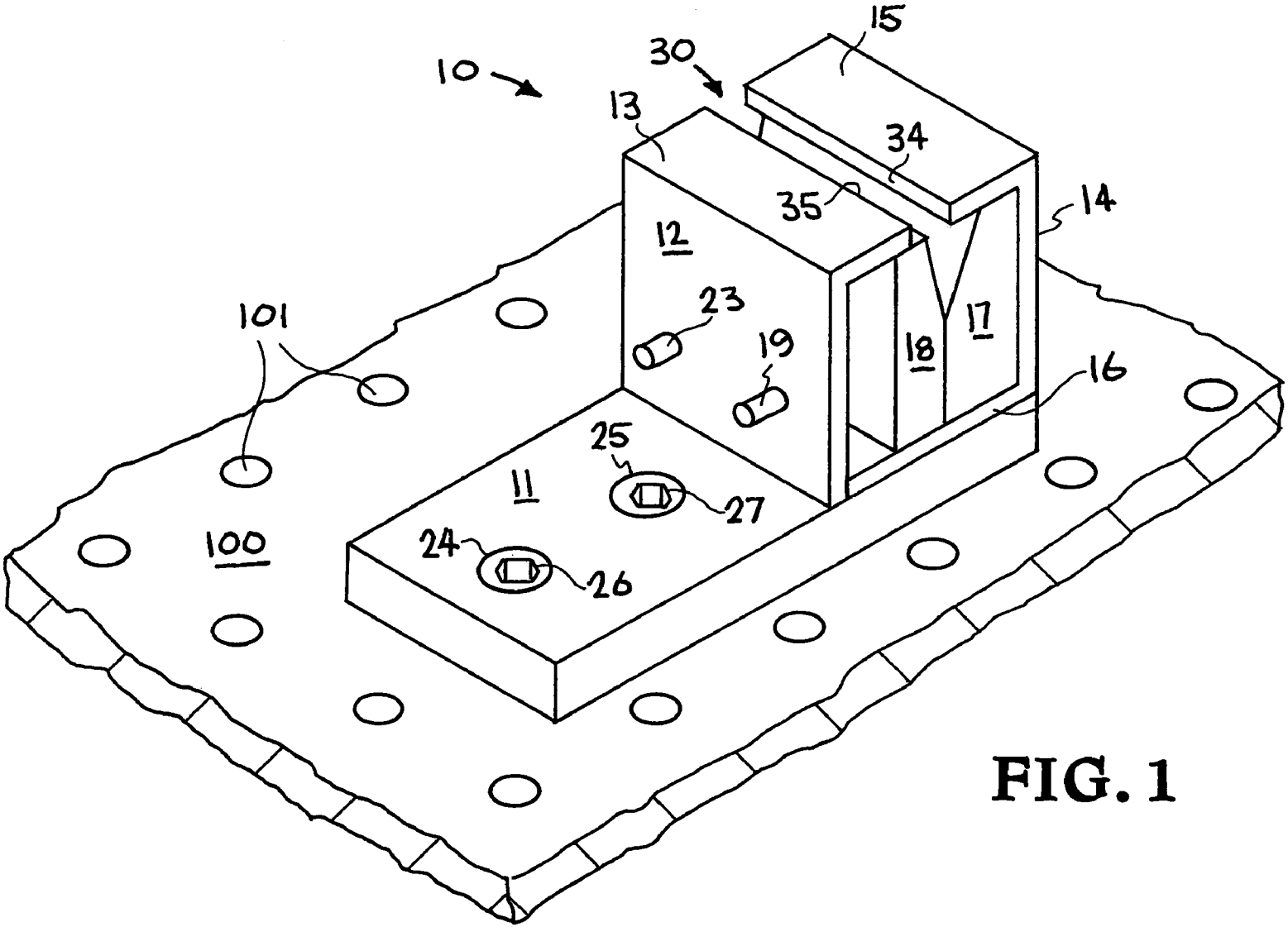
FIG. 1 is a perspective view of an exemplary embodiment of the present invention, shown mounted on a "bread board" of an optical table.
Figure 2:
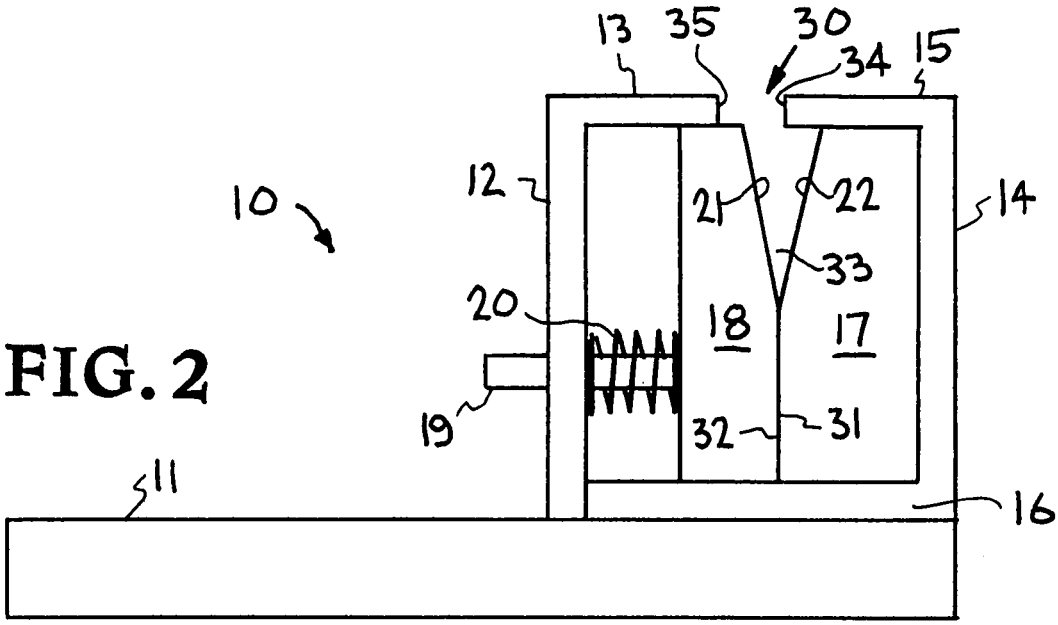
FIG. 2 is an elevational view of the exemplary embodiment of FIG. 1.

Turning now to the drawings, FIGS. 1 and 2 show an exemplary embodiment of the clamping device of the present invention, generally indicated at reference character 10. In particular, FIG. 1 shows a perspective view of the clamping device 10 mounted on a "bread board" of an optical table. And FIG. 2 is an elevational view of the clamping device 10 of FIG. 1. The clamping device 10 has a base plate 11 shown as a rectangular block. The base plate is shown having two mounting bores 24 and 25 capable of receiving fasteners, such as 26 and 27, which fasten the base plate 11 to a work surface, such as a bread board 100 shown having mounting holes 101, which are typically threaded bores.

Mounted on and carried by the base plate 10 is a first jaw 17 and a second jaw 18 shown positioned adjacent each other. In particular, the first jaw 17 is shown as a stationary block which is fixed with respect to the base plate 11. In contrast, the second jaw 18 is shown as a slidably displaceable block capable of sliding in a horizontal direction. The second jaw 18 is shown as a spring-loaded block, having two springs (e.g.

Figure 3:
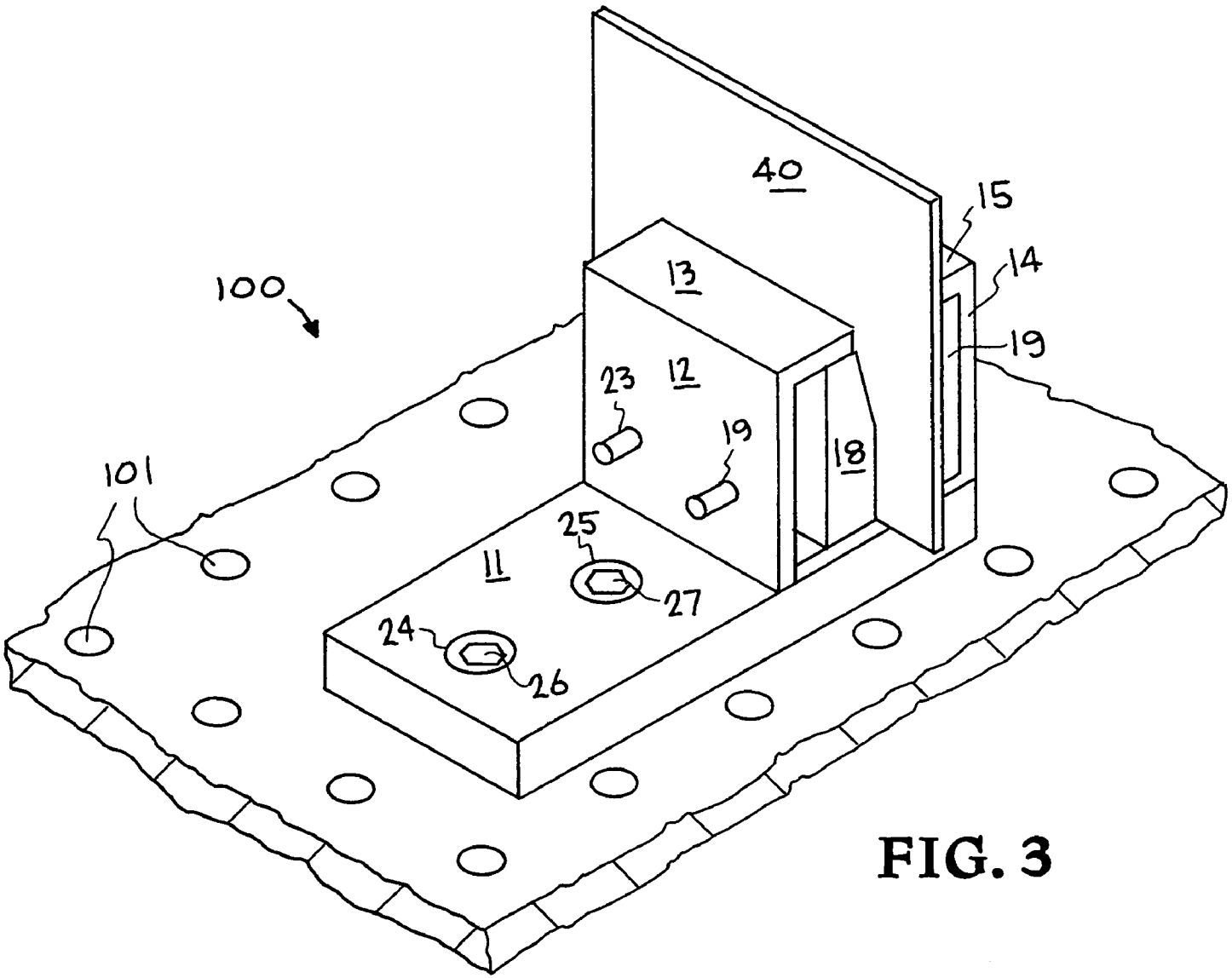
FIG. 3 is a perspective view similar to FIG. 1, shown with a mounted laser guard panel.

20) resiliently biasing the second jaw towards the first jaw. In particular, the spring 20 is shown surrounding a pin 19 connected at one end to the second jaw, and with the other end slidably extending through support wall 12 which is connected to the base plate. A second pin 23 is shown in FIG. 3 with the corresponding second spring hidden from view. It is appreciated that other resiliently biasing means known in the art other than a spring-pin mechanism may be used as an alternative.

Both the first and second jaws each have a clamping surface (31, 32) which, when the clamp is empty (i.e. no panel inserted), confronts each other and preferably abuts against each other such that a clamping force may be exerted via the clamping surfaces. And above the clamping surfaces 31, 32 is shown a V-shaped open channel mouth 33 formed by two faces 21, 22 of the two jaws 18, 17, respectively. It is appreciated that the V-shaped, open channel mouth can have various types of acute-angle or wedge-like cross sections, including an isometric cross-section such as shown in the drawings. While not shown in the drawings, it is also appreciated that one of the two faces 21, 22 may be a vertical face (e.g. an extension of the vertical clamping surface 31 or 32 shown in FIG. 2) while the other one of the two faces is acutely angled from vertical.

The clamping device 10 is also shown having a support structure having two vertical walls 12, 14 on opposite sides of the first and second jaws 17, 18, with each of the two vertical walls having a horizontal section extension 13, 15 extending centrally towards each other to form an open slotted aperture 30 which is positioned over and parallel with the open channel mouth 33. As shown in FIG. 2, the two vertical walls may be integrally connected via a base wall 16 used to connect the base plate 11. The open slotted aperture is formed and defined between a first slot edge 34 at the end of horizontal section 13, and a second slot edge 35 at the end of horizontal section 15. Preferably, as shown in FIG. 2, the first slot edge 34 is vertically aligned with the clamping surface 31 of the stationary/fixed first jaw 17. In this manner, the first slot edge 34 helps to keep an inserted panel vertical by abutting an upper region of the panel against the first slot edge. It is appreciated that the open slotted aperture 30 can serve to limit the size (thickness) of a panel which is inserted into the open channel mouth, and also limit the total number of panels which may be clamped, so as to prevent over-compression of and possible damage to the spring or other resiliently biasing means. It is also appreciated that the open slotted aperture 30 may be offset from the open channel mouth 33 as another method of controlling the number and manner of entry of panels into the open channel mouth 33.

Figure 4:
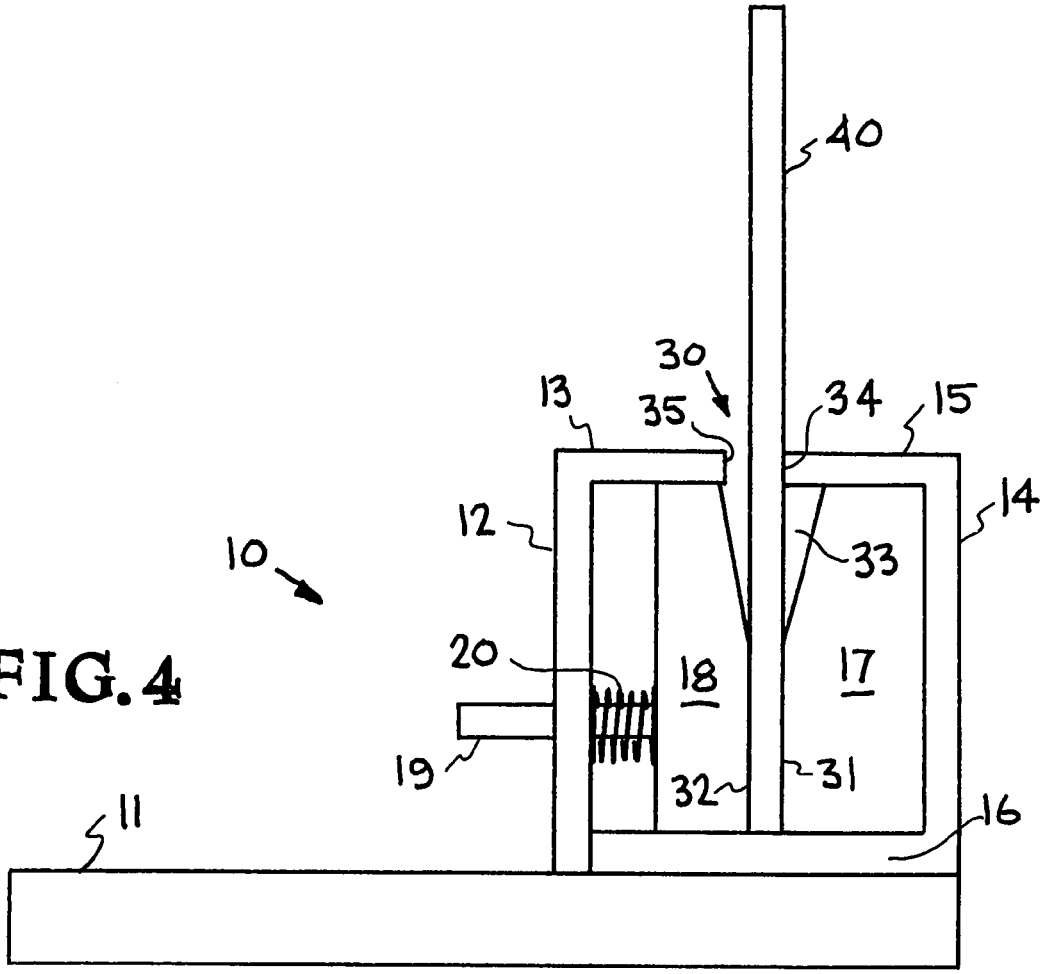
FIG. 4 is an elevational view of the exemplary embodiment of FIG. 3, shown with a mounted laser guard panel.

FIGS. 3 and 4 are similar to FIGS. and 1 and 2, except now shown with a guard panel 40 inserted and clamped between the first and second jaws 17, 18. Quick insertion of the guard panel 40 is enabled by the V-shaped open channel mouth 33 which enables wedge-action jaw separation by the panel 40 when inserted through the open channel mouth. Therefore, as the panel is inserted through the open channel mouth 30, the acute angled/wedge-shape of the mouth causes separation of the jaws (i.e. the springs e.g. 20 is compressed) and subsequent clamping of the guard panel between the clamping surfaces 31 and 32. Similarly, quick release of the panel 40 may be achieved by simply pulling the panel out from the clamp device 10.

Figure 5:
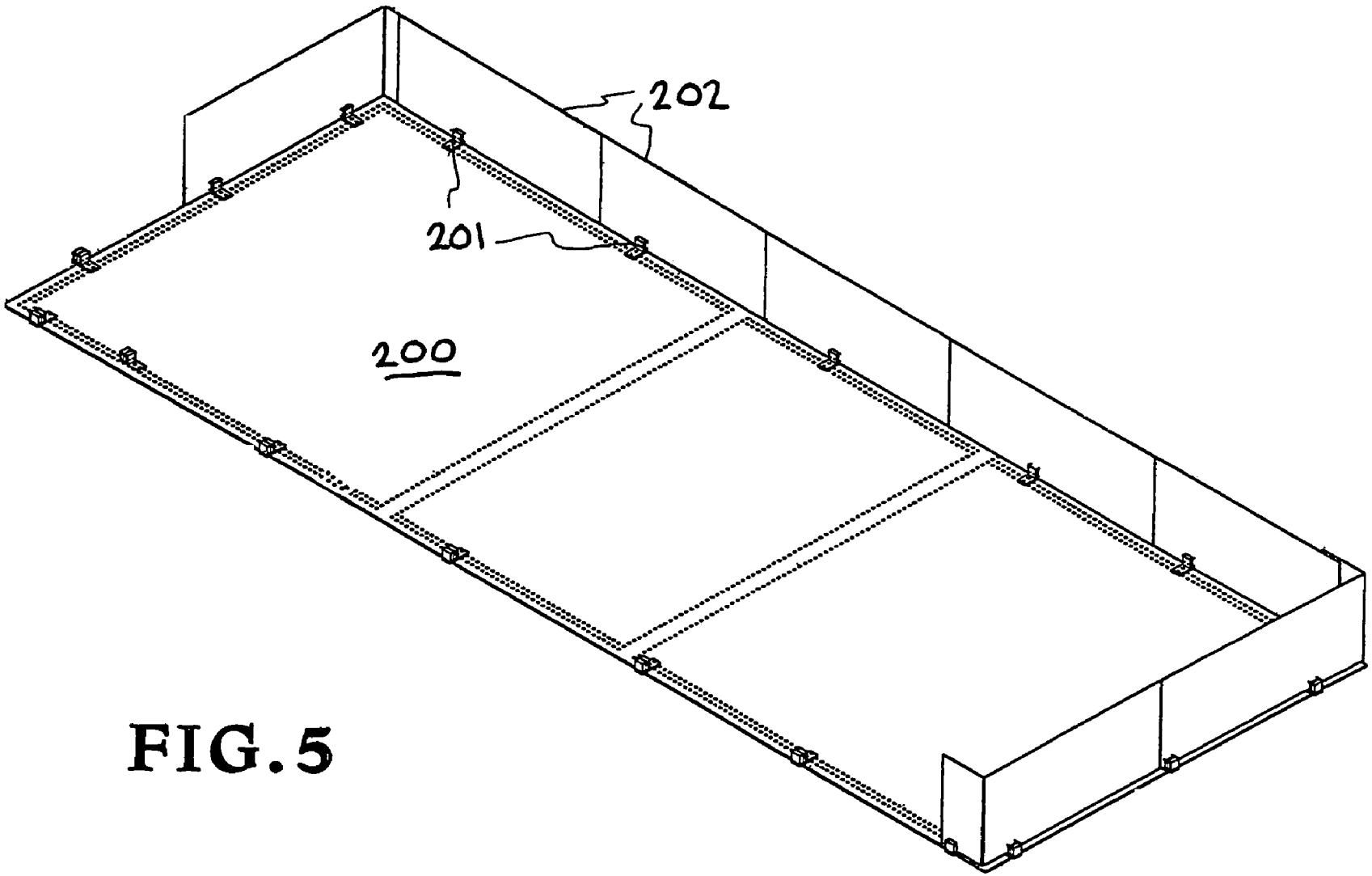
FIG. 5 is a perspective view of an optical table having multiple units of the laser beam guard clamps present invention arranged thereon with laser guard panels mounted thereon.

FIG. 5 illustrates a representative optical breadboard and table 200 having a plurality of clamping devices e.g. 201 mounted around the table, and guard panels e.g. 202 insertably mounted in the clamping devices. By pre-mounting the clamping devices at various locations on the optical table, the guard panels 202 may be quickly and easily re-positioned as necessary by simply inserting and pulling out from the existing clamping devices.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

I claim:

1. A clamping device comprising:

a base plate;

first and second jaws mounted on the base plate with at least one of said jaws being slidably displaceable relative to the other;

means for resiliently biasing the slidably displaceable jaw (s) towards the other jaw for exerting a clamping force therebetween, said first and second jaws each having a face acutely angled relative to the other face to form a V-shaped, open channel mouth for enabling wedge-action jaw separation by and subsequent clamping of a panel inserted through the open channel mouth, and means mounted on the base plate for providing an open slot aperture over and parallel with the open channel mouth with said open slot aperture defined between a first slot edge and a second slot edge.

2. The clamping device as in claim 1, wherein the first jaw is fixedly mounted on the base plate, and the second jaw is slidably carried by the base plate and resiliently biased by the resiliently biasing means towards the first jaw for exerting the clamping force therebetween, and the first slot edge is aligned with a clamping surface of the fixedly mounted first jaw.

3. The clamping device as in claim 1, wherein the means for resiliently biasing the slidably displaceable jaw(s) includes, for each slidably displaceable jaw, at least one spring having one end fixed with respect to the base plate, and the other end in contact with the slidably displaceable jaw.

4. The clamping device as in claim 1, further comprising means for mounting the base plate to a work surface.

5. A quick insert and release laser beam guard panel clamping apparatus comprising:

a base plate having means for mounting to an optical table;

a first jaw fixedly mounted on the base plate;

a spring-loaded second jaw slidably carried by the base plate and resiliently biased towards the first jaw for exerting a clamping force therebetween;

said first and second jaws each having a face acutely angled relative to the other face to form a V-shaped, open channel mouth for enabling wedge-action jaw separation by and subsequent clamping of a laser beam guard panel inserted through the open channel mouth; and means mounted on the base plate for providing an open slot aperture over and parallel with the open channel mouth with said open slot aperture defined between a first slot edge and a second slot edge.

* * * * *